US006788009B2

(12) United States Patent
Fujii et al.

(10) Patent No.: US 6,788,009 B2
(45) Date of Patent: Sep. 7, 2004

(54) METHOD AND DEVICE FOR LIGHTING ULTRA-HIGH PRESSURE DISCHARGE LAMPS

(75) Inventors: Toshitaka Fujii, Hyogo-ken (JP); Andrei Kazmierski, Hyogo-ken (JP)

(73) Assignee: Phoenix Electric Co., Ltd., Hyogo-ken (JP)

( * ) Notice: Subject to any disclaimer, the term of this patent is extended or adjusted under 35 U.S.C. 154(b) by 0 days.

(21) Appl. No.: 09/985,007

(22) Filed: Nov. 1, 2001

(65) Prior Publication Data

US 2002/0135324 A1 Sep. 26, 2002

(30) Foreign Application Priority Data

Mar. 23, 2001 (JP) ..... 2001-085665

(51) Int. Cl.[7] ..... H05B 37/02
(52) U.S. Cl. ..... 315/291; 315/224
(58) Field of Search ..... 315/224, 262, 315/278, 291, 313, 320, 276, 277, 282; H05B 37/02

(56) References Cited

U.S. PATENT DOCUMENTS 4,256,993 A * 3/1981 Morton ..... 315/106
4,613,792 A * 9/1986 Kroessler ..... 315/97
4,847,536 A * 7/1989 Lowe et al. ..... 315/127
4,998,045 A * 3/1991 Ruby ..... 315/209 R
5,109,181 A 4/1992 Fischer et al. ..... 313/571
5,221,877 A * 6/1993 Falk ..... 315/291
5,606,222 A * 2/1997 Cottaar et al. ..... 315/58
6,172,469 B1 * 1/2001 Kern ..... 315/307
6,215,252 B1 * 4/2001 Stanton ..... 315/224
6,232,728 B1 * 5/2001 Yamamoto et al. ..... 315/307
6,323,604 B1 * 11/2001 Boenigk et al. ..... 315/290
6,392,364 B1 * 5/2002 Yamamoto et al. ..... 315/291
6,400,087 B2 * 6/2002 van den Nieuwenhuizen et al. ..... 315/73

* cited by examiner

*Primary Examiner*—Don Wong
*Assistant Examiner*—Trinh Vo Dinh
(74) *Attorney, Agent, or Firm*—Oblon, Spivak, McClelland, Maier & Neustadt, P.C.

(57) ABSTRACT

There is provided an improved method of lighting an ultra-high pressure discharge lamp in which a pair of electrodes are disposed confronting each other with a spacing of not more than 1.5 mm therebetween in an arc tube forming part of an envelope of quartz glass, the arc tube encapsulating mercury in an amount of 0.15 mg/mm$^3$, the method including the steps of: reducing a lamp power supplied to the pair of electrodes to a degree such as not to stop arc discharge in a transition state from a lighting state to extinction; keeping the lamp power thus reduced for a predetermined time period; and shutting down the supply of current to the electrodes.

4 Claims, 5 Drawing Sheets

METHOD AND DEVICE FOR LIGHTING ULTRA-HIGH PRESSURE DISCHARGE LAMPS

BACKGROUND OF THE INVENTION

1. Field of the Invention

The present invention relates to method and device for lighting ultra-high pressure discharge lamps capable of minimizing deposition of metallic mercury on electrode surfaces, ensuring early stabilization of arc, preventing blackening, and avoiding the formation of mercury bridge at least between tip ends of the electrodes.

2. Description of the Related Art

Recently, ultra-high pressure discharge lamps are frequently used as light sources in information systems such as a liquid crystal projector. Acute competition exists in pursuit of an ultra-high pressure discharge lamp that is capable of providing a sharper and brighter picture, being used as a smaller point light source, offering a higher luminance, and enjoying a longer lifetime for use as a light source in liquid crystal projectors in particular. To meet such demands, the internal volume of an arc tube forming part of an envelope has been gradually reduced. Quite recently, an arc tube having an internal volume as small as about a half of a typical tube has been developed. With this downsizing trend, the spacing between electrodes becomes very narrow or as small as 1.5 to 1 mm. On the other hand, the amount of mercury filled in such an arc tube per unit volume of the tube has been largely increased. Quite recently, the amount of filled mercury has become about twice as large as the typical amount. For this reason, in an extreme case, metallic mercury that has condensed on an electrode surface upon extinction of the lamp is evaporated by absorbing the heat of arc in initiating lighting of the lamp, with the result that the temperature of the electrodes is prevented from rising thereby hindering the formation of a hot arc spot, hence causing arc to break off. Another problem associated with the downsizing trend is that a mercury drop condensed upon extinction of the lamp extends between the electrodes to form a mercury bridge which short-circuits the lamp, thereby hindering the lamp from lighting.

The condensation of metallic mercury on electrode surfaces and the formation of a mercury bridge resulting from growth of condensed metallic mercury are considered to occur as follows. Typically, an ultra-high pressure discharge lamp is used as attached to a concave reflecting mirror. The ultra-high pressure discharge lamp attached to the concave reflecting mirror is cooled by direct blowing into the concave reflecting mirror or to the lamp-receiving portion of the mirror. Then, at least one of the pair of electrodes of the ultra-high pressure discharge lamp is cooled faster than mercury vapor still kept at a high temperature in the arc tube. The mercury vapor is then deposited and condensed on the electrode thus cooled, and the condensed mercury gradually grows into a mercury drop, which in turn flows into the narrow spacing between the electrodes to form a mercury bridge.

Even if such a mercury bridge is not formed, a large amount of mercury is deposited on the electrode surface as described above so that arc generated from the deposited mercury in initiating lighting of the lamp moves unstably on the electrode surface until the deposited mercury has been thoroughly evaporated. Particularly where the ultra-high pressure discharge lamp is an AC discharge lamp adapted to start lighting with direct current in an early lighting stage (0.5 to 5 seconds) and thereafter to light with alternating current of low frequency, the cathode is hard to heat and is derived of heat by mercury if deposited in a large amount thereon so that arc is likely to break off. This tendency is conspicuous when air-cooling is adopted as described above. It is conceivable to prolong the high-voltage-generating period in order to prevent arc from breaking off. However, this cannot be said to be desirable in terms of safety. Further, if the time period for which arc is instable as described above is prolonged, the sputtering action of arc causes the electrode material to scatter and adhere to the inner surface of the arc tube, thus causing a blackening phenomenon. FIG. 8 is a block diagram of a prior art lamp lighting circuit, and FIG. 9 is a time chart of the operation of this lamp lighting circuit. As shown, the lamp lighting circuit includes an igniter section 30 for applying high voltage pulses in initiating lighting of an ultra-high pressure 1, a stabilized lighting circuit 31 for stabilized supply of a lighting power to the ultra-high pressure discharge lamp 1 during a steady lighting stage, and a power control section 32 for controlling the stabilized lighting circuit 31. Upon receipt of a lamp lighting control signal (lamp extinguishing signal), the ultra-high pressure discharge lamp 1 is extinguished and then the deposition of mercury or the formation of a mercury bridge proceeds as described above.

Accordingly, it is an object of the present invention to improve the lighting performance of an ultra-high pressure discharge lamp by minimizing condensation of mercury on electrode surfaces following extinction of the lamp. Specifically, the object of the present invention is to provide method and device for lighting an ultra-high pressure discharge lamp capable of stabilizing arc in a shorter time and preventing the occurrence of blackening and the formation of a mercury bridge.

SUMMARY OF THE INVENTION

In accordance with a first aspect of the present invention, there is provided a method of lighting an ultra-high pressure discharge lamp in which a pair of electrodes are disposed confronting each other with a spacing of not more than 1.5 mm therebetween in an arc tube forming part of an envelope of quartz glass, the arc tube encapsulating mercury in an amount of 0.15 mg/mm$^3$, the method comprising the steps of:

reducing a lamp power supplied to the pair of electrodes to a degree such as not to stop arc discharge in a transition state from a lighting state to extinction;

keeping the lamp power thus reduced for a predetermined time period; and shutting down the supply of current to the electrodes.

With this method, feeble arc is generated between the electrodes in the transition state from a lighting state to extinction. For this reason, the temperature of the electrodes is kept higher than the evaporating temperature of mercury and, hence, mercury vapor does not condense even when contacting the surfaces of the electrodes. Since the envelope is under cooling, mercury vapor contacting the inner surface of the arc tube condenses and gradually grows thereon while gradually reducing the pressure of mercury vapor within the arc tube.

When the supply of current to the electrodes is shut down at the time the mercury vapor pressure within the arc tube has lowered sufficiently, residual mercury vapor, the amount of which is very small, starts condensing. Since the residual mercury vapor preferentially condenses on the arc tube already cooled rather than on the electrodes just finished with arc discharge and hence still in a heated state, condensation of mercury on the electrodes is limited. As a result, a mercury bridge is not formed at all.

Further, since the deposition of mercury on the electrodes is very little, the small amount of mercury on the electrodes serving as a starting point of arc generated between the electrodes in initiating re-lighting of the lamp is evaporated in a short time and, hence, the arc moves to between the confronting ends of the electrodes and is maintained stably thereat. Accordingly, the arc moving period in the initiating stage is very short, so that the occurrence of blackening due to sputtering during the arc moving period in the initiating stage is restrained, thus contributing to an improvement in the lifetime of the lamp.

In one embodiment, the lamp power is reduced to a value ½ to 1/20 times as large as a rated output of the discharge lamp.

In another embodiment, the time period of keeping the reduced lamp power is 1 to 20 seconds.

In accordance with another aspect of the present invention, there is provided a device for lighting an ultra-high pressure discharge lamp, comprising: an igniter for initiating lighting of the ultra-high pressure discharge lamp by applying pulses of a high voltage thereto; a stabilized lighting circuit connected to the igniter for causing the ultra-high pressure discharge lamp to perform stabilized lighting; and a power control section for controlling power supply from the stabilized lighting circuit to the ultra-high pressure discharge lamp, the power control section having a lamp power output reduction control function which serves to control the stabilized lighting circuit so that a lighting power is stably supplied from the stabilized lighting circuit to the high-pressure discharge lamp in a steady lighting stage while controlling the stabilized lighting circuit so that a power outputted to the ultra-high pressure discharge lamp is reduced to a lamp power such as not to stop arc discharge between a pair of electrodes in a transition state from steady lighting to extinction of the ultra-high pressure discharge lamp.

These and other objects, features and attendant advantages of the present invention will become apparent from the reading of the following detailed description of the invention in conjunction with the accompanying drawings.

DETAILED DESCRIPTION OF THE PREFERRED EMBODIMENTS

The present invention will now be described in detail by way of preferred embodiments thereof with reference to the accompanying drawings.

Figure 1:
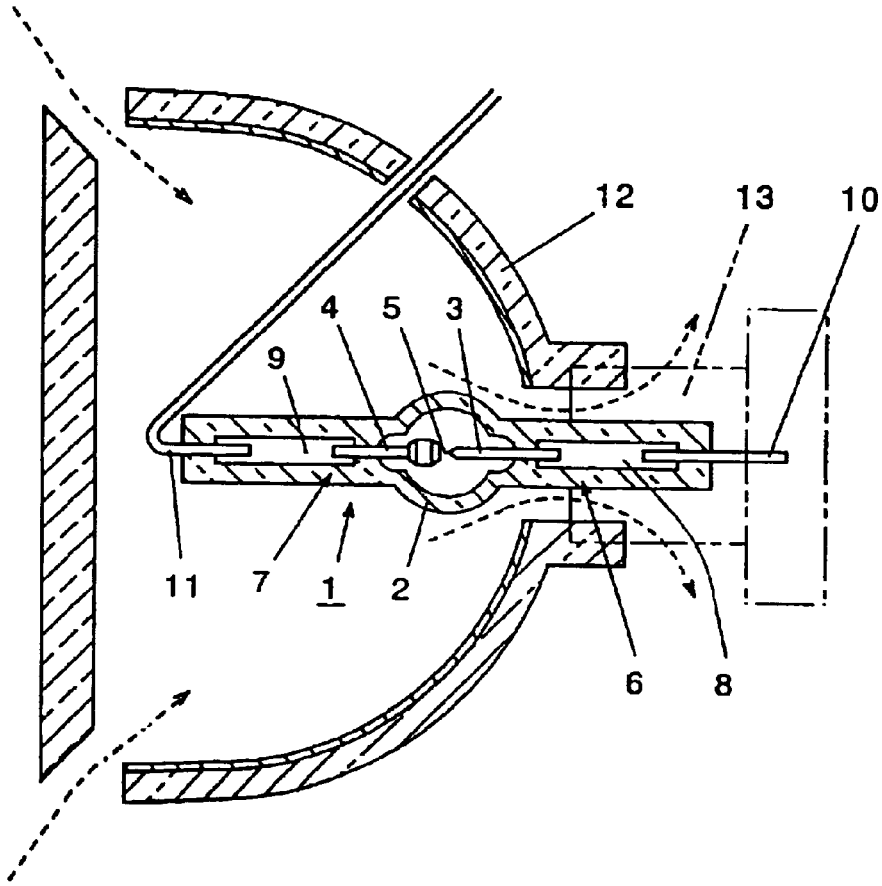
FIG. 1 is a sectional view showing an ultra-high pressure discharge lamp attached to a concave reflecting mirror to which the present invention is applied.

FIG. 1 is a front view showing a first embodiment of ultra-high pressure discharge lamp (A) to which the lighting method of the present invention is applied. Briefly, the ultra-high pressure discharge lamp (A) includes an envelope 1 of quartz glass, a spherical or ellipsoidal arc tube 2 located centrally of the envelope 1, a pair of electrodes 3 and 4 disposed confronting each other with a predetermined spacing (1 to 1.5 mm, specifically 1.3 mm in this embodiment) therebetween in the arc tube 2, molybdenum foils 8 and 9, respectively, embedded in seal portions 6 and 7 continuous with and extending from the opposite ends of the arc tube 2, the foils 8 and 9 each having one end welded to an embedded end of the corresponding one of the electrodes 8 and 9, and external leads 10 and 11 each welded to the other end of the corresponding one of the molybdenum foils 8 and 9. The arc tube 2 encapsulates therein mercury, a rare gas (for example, argon), and optionally a halogen.

It is to be noted that though the ultra-high pressure discharge lamp (A) may be adapted for either direct current or alternating current, it is adapted for direct current in this embodiment and, hence, the electrodes 3 and 4 are called cathode 3 and anode 4, respectively.

In the case where the rated power of the ultra-high pressure discharge lamp (A) is 270 W, the spacing between the electrodes is not more than 1.5 mm (for example, 1 to 1.5 mm, specifically 1.3 mm in this embodiment), the internal volume of the arc tube 2 is 0.43 cc, the arc length is 1.3 mm, the bulb wall loading is 0.9 $W/mm^2$, and the amount of filled mercury is 84 mg (0.19 $mg/mm^3$).

The ultra-high pressure discharge lamp (A) thus constructed is used with one of the seal portions 6 and 7 fitted into a lamp-receiving portion 13 located centrally of the concave reflecting mirror 12.

Figure 2:
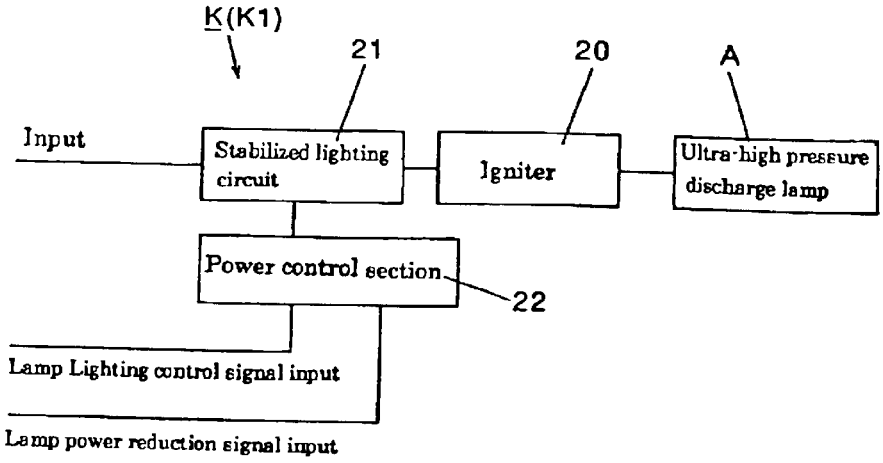
FIG. 2 is a block circuit diagram of a first embodiment of a device for lighting an ultra-high pressure discharge lamp for carrying out the present invention.

FIG. 2 is a block circuit diagram of a first embodiment (K1) of a device (K) for lighting the ultra-high pressure discharge lamp (A) according to the present invention. The ultra-high pressure discharge lamp lighting device (K1) includes an igniter 20 for generating pulses of a high voltage in initiating lighting of the ultra-high pressure discharge lamp (A) and applying the pulses to the ultra-high pressure discharge lamp (A) to initiate lighting of the lamp, a stabilized lighting circuit 21 connected to the igniter 20 for causing the ultra-high pressure discharge lamp (A) to perform stabilized lighting in a stabilized lighting stage while reducing a lamp power supplied to the ultra-high pressure discharge lamp (A) in a transition stage from the stabilized lighting stage to extinction, and a power control section 22 for controlling the stabilized lighting circuit 21 so that a lighting power supply from the stabilized lighting circuit 21 to the ultra-high pressure discharge lamp (A) is stabilized in a steady lighting stage while the lamp power supplied to the ultra-high pressure discharge lamp (A) is reduced in the transition stage from the stabilized lighting stage to extinction.

The power control section 22 is adapted to receive a lamp lighting control signal (inclusive of ON/OFF signals) controlling ON/OFF of the ultra-high pressure discharge lamp (A) and a lamp power output reduction control signal for controlling the stabilized lighting circuit 21 so that a power outputted to the ultra-high pressure discharge lamp (A) is reduced to a reduced lamp power such as not to stop arc discharge 5 between the pair of electrodes 3 and 4 in the transition state from the stabilized lighting stage to extinction of the ultra-high pressure discharge lamp (A).

The operation of the ultra-high pressure discharge lamp (A) provided with the lamp lighting device (K) is as follows. The arc tube 2 of the ultra-high pressure discharge lamp (A) in an extinct state is in a cooled state and, hence, the filled mercury mostly remains in the form of drop within the arc tube 2 with little mercury deposited on the surfaces of the electrodes 3 and 4.

Figure 7:
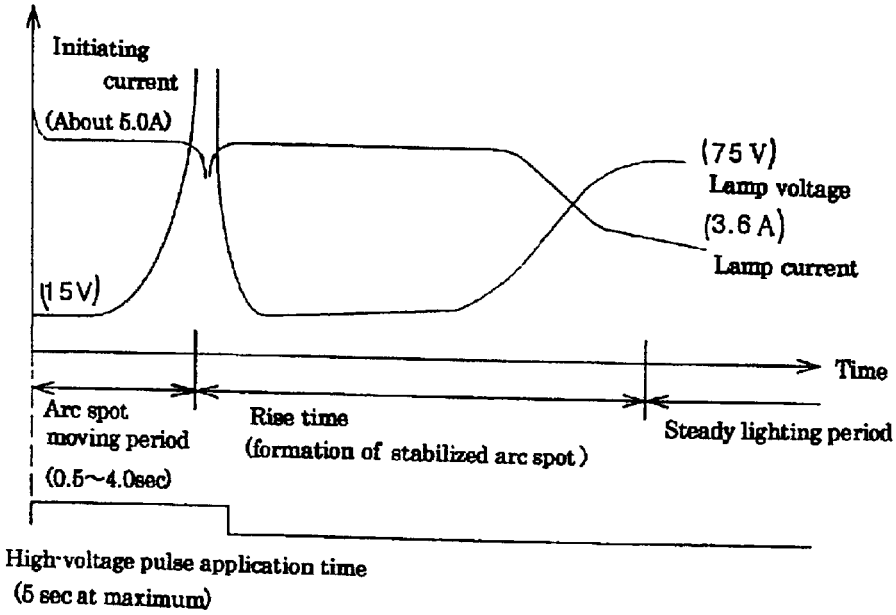
FIG. 7 is a graphic representation of the relationship between lamp current and lamp voltage in initiating lighting of the ultra-high pressure discharge lamp shown in FIG. 6.
Figure 8:
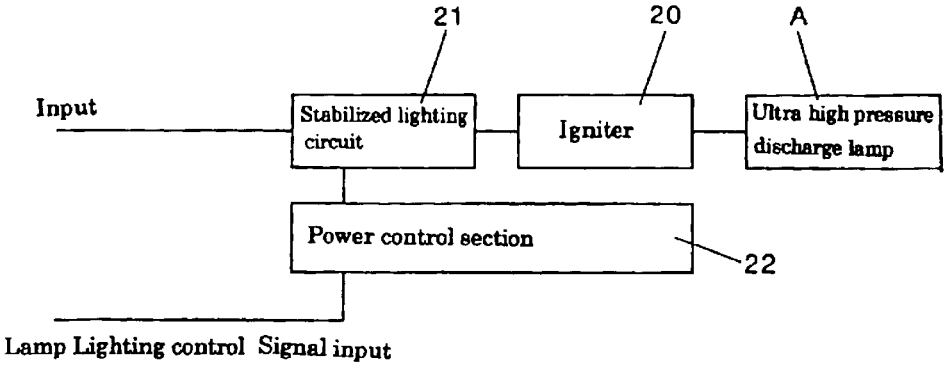
Background Art Fig.8
FIG. 8 is a block circuit diagram of a prior art ultra-high pressure discharge lamp lighting device.
Figure 9:
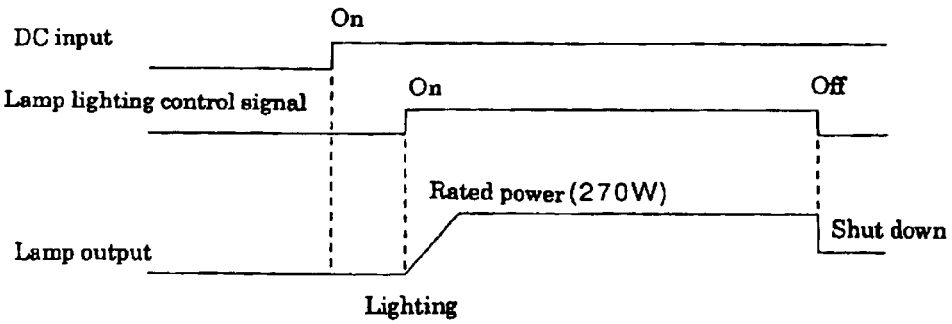
Background Art Fig.9
FIG. 9 is a time chart of the prior art ultra-high pressure discharge lamp lighting device shown in FIG. 8.

The stabilized lighting circuit 21 of the lamp lighting device (K) is applied with a DC input of 300 V for example. When the lamp lighting control ON signal is inputted to the power control section 22 with the lamp lighting device (K) applied with the DC input, the igniter 20 is actuated in response to the DC input to apply pulses of a high voltage to the ultra-high pressure discharge lamp (A) so that lighting of the lamp (A) is initiated, resulting generation of arc 5 between the electrodes 3 and 4. In the early stage of the lamp initiating operation, the arc spot moves on the surface of the cathode 3. This stage corresponds to the arc spot moving period in FIG. 7 and fluctuates between 0.5 seconds and 4 seconds depending on the state of mercury deposited on the electrodes. In the subject embodiment (270 W ultra-high pressure discharge lamp (A)), the initiating current used is about 5 A. Discharge generated during the early stage of the initiating operation is discharge through the rare gas and, hence, the resulting voltage is as low as about 15 V.

As the cathode 3 is heated, arc 5 moves to the tip end of the cathode 3 and forms a stable arc spot. At the moment the arc 5 moving on the cathode 3 moves to the tip end of the cathode 3, the arc 5 is likely to become extinguished. This phenomenon is represented as a rise in the lamp voltage in FIG. 7. This problem can be resolved if arc is generated again by applying pulses of a high voltage. Accordingly, high-voltage pulses need be generated for a time period longer than a maximum value of the arc spot moving period. After the formation of the stable arc spot, the lamp voltage rises as the filled mercury evaporates. This is represented as a rise time in FIG. 7. After lapse of several minutes, stabilized lighting at the rated power (270 W for example) is reached. At this time the lamp voltage is about 75 V. This is represented by a steady lighting period in FIG. 7. The behavior of arc in the ultra-high pressure discharge lamp (A) will be described later.

When a liquid crystal projector using the ultra-high pressure discharge lamp (A) as a light source is turned OFF, the power control section 22 first receives the lamp power reduction signal. Upon receipt of this signal, the power control section 22 reduces its output power to a predetermined reduced lamp power and keeps the reduced lamp power for a predetermined time period (1 to 20 seconds) to maintain the arc discharge between the electrodes 3 and 4. Since the ultra-high pressure discharge lamp (A) is forcibly cooled during this period, the arc tube 2 is cooled to a degree such as to allow condensation of mercury, although a portion around the arc 5 and the electrodes generating the arc 5 are kept at high temperatures. Accordingly, mercury vapor present at locations other than the locations around the arc and adjacent the electrodes contacts the inner surface of the arc tube and gradually condenses thereon.

In this case, the lower the reduced lamp power, the lower lamp temperature can be reached and, hence, the condensation of mercury proceeds more rapidly, resulting in a shortened time up to extinction. However, it is required that the lamp power be kept at a value such as not extinguish the arc in this transition period. The value to which the lamp power is reduced is ½ to 1/20 times the rated power. When the reduced lamp power in the transition period is ½ times the rated power, condensation of mercury vapor is possible if the lamp is forcibly cooled. If the reduced lamp power is less than 1/20 times the rated power, arc may be extinguished. Accordingly, the reduced lamp power is at least 1/20 times the rated power, usually about 1/5 times the rated power. In the case of ultra-high pressure discharge lamp (A) having a rated power of 270 W, the reduced lamp power is about 50 W.

The lighting maintaining time after the lamp power has been reduced becomes shorter with a larger reduction in the lamp power. When the reduced lamp power is about 1/20 times the rated power, condensation of mercury vapor completes in one second or a little more than one second. When the reduced lamp power is about ½ times the rated power, mercury vapor condenses in about 20 seconds with substantially the whole amount thereof remaining in the arc tube 2 with little mercury deposited on the surfaces of the electrodes 3 and 4.

After lapse of the lighting time at the reduced lamp power, a power supply OFF signal is input to the power control section 22 to extinguish the ultra-high pressure discharge lamp (A).

The ultra-high pressure discharge lamp (A) thus extinguished is re-lighted as follows. When direct current is supplied to the electrodes 3 and 4, thermions are emitted from the cathode 3 toward the anode 4 to generate arc 5 between the electrodes 3 and 4. Immediately after the initiation of arc discharge, the arc spot moves on the surface of the cathode 3 for a while. At the time the cathode 3 is heated to a certain degree, the arc spot moves to the tip end of the cathode 3 and becomes a hot arc spot thereat. If a large amount of mercury is deposited on the surface of the cathode 3 as described earlier, the hot arc spot does not stop moving until the deposited mercury has been thoroughly evaporated because hot arc is generated from the deposited mercury.

In the case of ultra-high pressure discharge lamp (A) adapted for direct current, the cathode 3 is cooled more rapidly than the anode 4 when the lamp (A) is extinguished and, hence, mercury is preferentially deposited on the cathode 3 side. For this reason, the hot arc spot is not formed until the mercury on the cathode 3 has been thoroughly evaporated, with the result that the time period for which arc 5 moves on the cathode 3 is liable to be prolonged (about 4 seconds according to the prior art).

The high-voltage pulse application time in initiating lighting of the ultra-high pressure discharge lamp (A) has to be longer than the arc moving period. This is because arc 5 is likely to become extinguished at a moment arc 5 moves to between the tip ends of the electrodes 3 and 4 unless high-voltage pulses are applied to the electrodes 3 and 4 at this moment. Further, a longer arc moving period causes tungsten forming the electrodes 3 and 4 to scatter and adhere to the inner surface of the arc tube 2, thus causing blackening of the lamp (A).

According to the present invention, in contrast, the electrodes 3 and 4 are supplied with a reduced lamp power which is much lower than the rated power for a predetermined period of time during the transition period from the steady lighting stage to extinction to keep generation of arc. This makes it possible to minimize deposition of mercury on the electrodes 3 and 4 thereby shortening the time required for evaporation of mercury on the surfaces of the electrodes 3 and 4 in re-lighting the lamp. Accordingly, it is possible to remarkably shorten the arc moving period, to minimize the probability of arc breaking-off in initiating lighting of the lamp, and to considerably decrease the likelihood of blackening.

Figure 3:
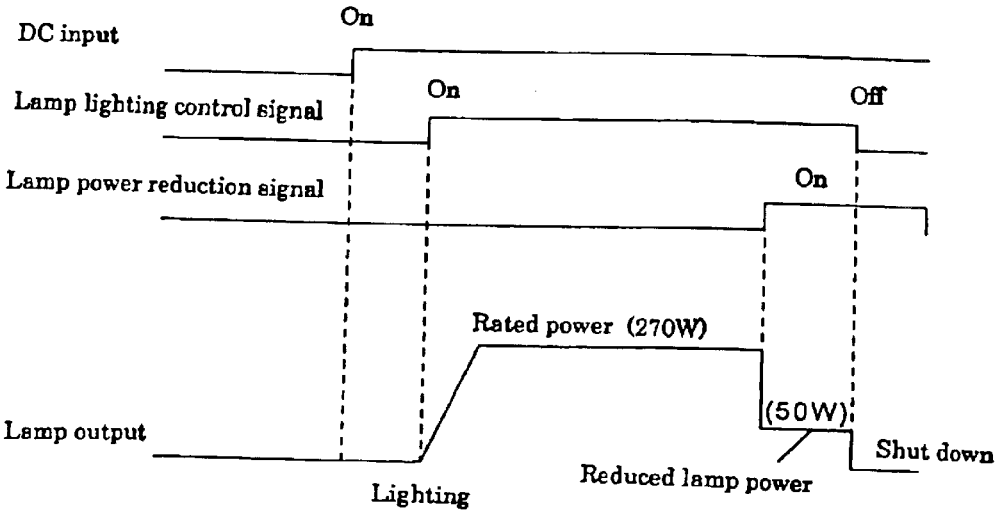
FIG. 3 is a time chart of the ultra-high pressure discharge lamp lighting device shown in FIG. 2.
Figure 4:
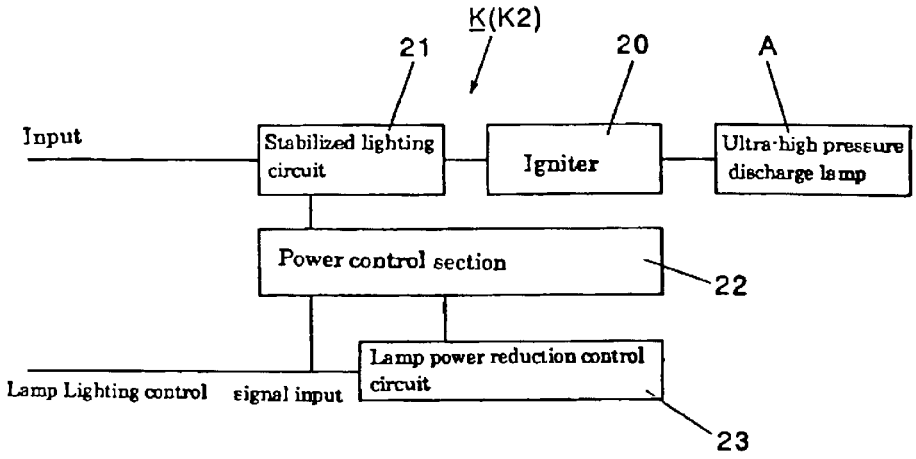
FIG. 4 is a block circuit diagram of a second embodiment of a device for lighting an ultra-high pressure discharge lamp for carrying out the present invention.
Figure 5:
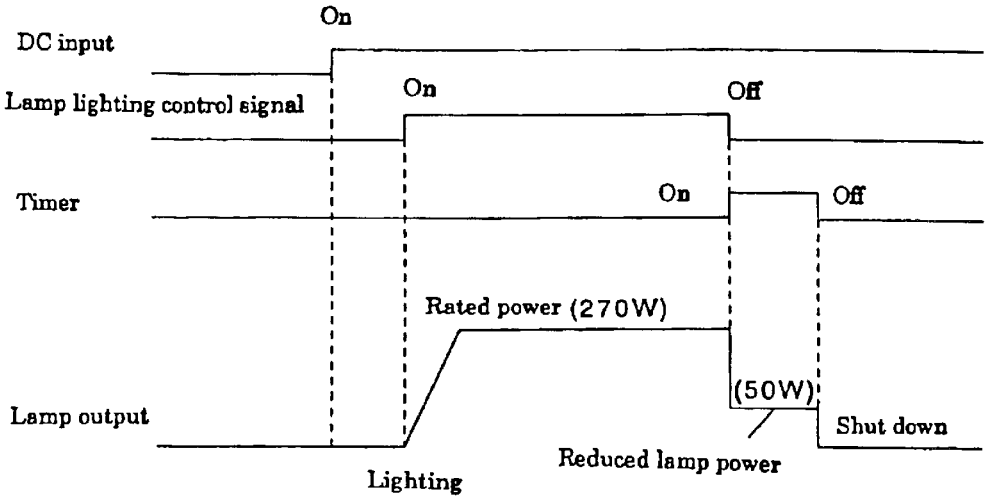
FIG. 5 is a time chart of the ultra-high pressure lamp lighting device shown in FIG. 4.
Figure 6:
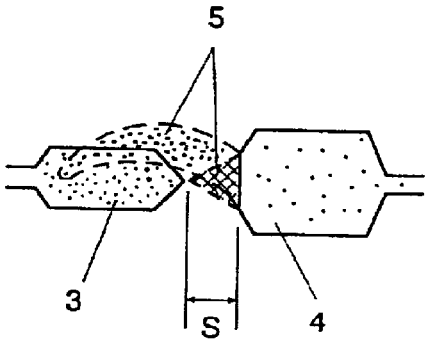
FIG. 6 is an enlarged schematic view of confronting ends of electrodes for illustrating arc behavior in initiating lighting of an ultra-high pressure discharge lamp.

FIG. 3 is a block circuit diagram of another embodiment (K2) of lighting circuit (K). The embodiment (K2) differs from the foregoing lighting circuit (K1) in that a lamp power reduction control circuit 23 connected to the power control section 22 is additionally provided and lamp lighting control signals are adapted to be inputted to both the power control section 22 and the lamp power reduction control circuit 23. With this configuration, when a lamp lighting control OFF signal is inputted to the power control section 22 and the lamp power reduction control circuit 23, the lamp power reduction control circuit 23 is actuated so that the power control section 22 controls the stabilized lighting circuit 21 so as to supply a reduced lamp power for a predetermined time period (1 to 20 seconds preset by a timer, for example). When the reduced lamp power supply time is elapsed, the lamp is turned OFF.

According to the present invention, the method of lighting an ultra-high pressure discharge lamp in which a pair of electrodes are disposed confronting each other with a very small spacing therebetween and a very large amount of mercury is filled in an arc tube, comprises the steps of: reducing a lamp power supplied to the pair of electrodes to a degree such as not to stop arc discharge in a transition state from a lighting state to extinction of the lamp; keeping the lamp power thus reduced for a predetermined time period; and shutting down the supply of current to the electrodes. With this method, feeble arc is generated with the electrodes kept at a temperature higher than the evaporating temperature of mercury during the transition period, whereas the arc tube is cooled. Accordingly, mercury vapor contacting the inner surface of the arc tube condenses and gradually grows thereon, while the pressure of mercury vapor within the arc tube gradually decreases. As a result, mercury vapor mostly condenses and remains in the arc tube with little condensation of mercury on the electrode surface. Thus, it is possible to perfectly prevent the formation of a mercury bridge, to stabilize lighting of the lamp, and eliminate the cause of blackening.

The device of the present invention has a lamp power output reduction control function which serves to reduce the power outputted to the ultra-high pressure discharge lamp to a lamp power such as not to stop arc discharge between a pair of electrodes in a transition state from steady lighting to extinction of the ultra-high pressure discharge lamp. This function makes it possible to ensure stabilized lighting of the ultra-high pressure discharge lamp as well as to considerably restrain the formation of a mercury bridge and the occurrence of blackening.

While only certain presently preferred embodiments of the present invention have been described in detail, as will be apparent for those skilled in the art, certain changes and modifications may be made in embodiments without departing from the spirit and scope of the present invention as defined by the following claims.

What is claimed is:

1. A method of lighting an ultra-high pressure discharge lamp in which a pair of electrodes are disposed confronting each other with a spacing of not more than 1.5 mm therebetween in an arc tube forming part of an envelope of quartz glass, an arc tube encapsulating mercury in art amount of 0.15 mg/mm$^3$, the method comprising the steps of:

operating the lamp at a first lamp power;

reducing a lamp power supplied to the pair of electrodes to a reduced level that enables arc discharge in a transition state from a lighting state to extinction such that the temperature of the electrodes remains higher than an evaporating temperature of the arc tube encapsulating mercury to prevent deposition of the mercury on said pair of electrodes, thereby beginning a shutdown process for the lamp;

maintaining the lamp power at the reduced level for a predetermined time period; and shutting down a supply of current to the electrodes.

2. The method according to claim 1, wherein the lamp power is reduced to a value approximately ½ to approximately 1/20 times a rated output of the discharge lamp.

3. The method according to claim 1 or 2, wherein the time period of keeping the reduced lamp power is approximately 1 second to approximately 20 seconds.

4. A device for lighting an ultra-high pressure discharge lamp, comprising:

an igniter for initiating lighting of the ultra-high pressure discharge lamp by applying pulses of a high voltage thereto;

a stabilized lighting circuit connected to the igniter for causing the ultra-high pressure discharge lamp to perform stabilized lighting; and a power control section for controlling power supply from the stabilized lighting circuit to the ultra-high pressure discharge lamp, the power control section having a lamp power output reduction control function which serves to control the stabilized lighting circuit so that a first lighting power is stably supplied from the stabilized lighting circuit to the high-pressure discharge lamp in steady lighting, while controlling the stabilized lighting circuit so that a second lighting power outputted to the ultra-high pressure discharge lamp is reduced to a lamp power that enables arc discharge between a pair of electrodes in a transition state from steady lighting to extinction of the ultra-high pressure discharge lamp such that the temperature of the electrodes remains higher than an evaporating temperature of a mercury to prevent deposition of the mercury on said pair of electrodes, wherein the second lighting power is applied to begin a shutdown process of the lamp, and wherein the pair of electrodes are positioned not more than 1.5 mm apart.

* * * * *